US006778082B2

(12) United States Patent
Goodwin

(10) Patent No.: US 6,778,082 B2
(45) Date of Patent: Aug. 17, 2004

(54) SMOKE DETECTOR SYSTEM FOR A HOUSE

(76) Inventor: Jason Goodwin, 4461 Tuma Rd., Yorkville, IL (US) 60560

( * ) Notice: Subject to any disclaimer, the term of this patent is extended or adjusted under 35 U.S.C. 154(b) by 0 days.

(21) Appl. No.: 10/037,975

(22) Filed: Jan. 3, 2002

(65) Prior Publication Data

US 2002/0093430 A1 Jul. 18, 2002

Related U.S. Application Data

(60) Provisional application No. 60/262,751, filed on Jan. 18, 2001.

(51) Int. Cl.[7] ..... G08B 1/08

(52) U.S. Cl. ..... 340/539.1; 340/628; 340/508; 340/521; 340/533; 340/584; 340/632; 340/636; 340/693.2

(58) Field of Search ..... 340/539.1, 628, 340/508, 521, 533, 584, 632, 636, 693.2

(56) References Cited

U.S. PATENT DOCUMENTS 4,176,346 A * 11/1979 Johnson et al. ..... 340/524
4,282,519 A * 8/1981 Haglund et al. ..... 340/628
4,363,031 A * 12/1982 Reinowitz ..... 340/539
4,737,769 A * 4/1988 Masot ..... 340/533
4,812,821 A * 3/1989 Santy et al. ..... 340/538
4,916,432 A * 4/1990 Tice et al. ..... 340/518
5,587,705 A * 12/1996 Morris ..... 340/628
5,786,767 A * 7/1998 Severino ..... 340/628
5,889,468 A * 3/1999 Banga ..... 340/628
5,898,369 A * 4/1999 Godwin ..... 340/539
5,949,332 A * 9/1999 Kim ..... 340/539
5,973,603 A * 10/1999 Judy ..... 340/628

* cited by examiner

*Primary Examiner*—Daniel J. Wu
*Assistant Examiner*—Tai T. Nguyen
(74) *Attorney, Agent, or Firm*—Welsh & Katz, Ltd.

(57) ABSTRACT

A method and apparatus are provided for activating smoke detector alarms within a house. The method includes the steps of providing a plurality of smoke detectors dispersed among a plurality of locations within the house, detecting smoke within a first smoke detector of the plurality of smoke detectors, transmitting a radio frequency signal from the first smoke detector to a second smoke detector of the plurality of smoke detectors upon detection of smoke by the first smoke detector and activating an alarm within the second smoke detector upon detection of the radio frequency signal from the first smoke detector.

18 Claims, 1 Drawing Sheet

SMOKE DETECTOR SYSTEM FOR A HOUSE

This application claims the benefit of provisional application 60/262,751 filed on Jan. 18, 2001.

FIELD OF THE INVENTION

The field of the invention relates to fire detection devices and more particularly to smoke detectors.

BACKGROUND OF THE INVENTION

Smoke detectors are known. Such devices are typically mounted in various locations around houses and apartment buildings to provide advance warning in the event of fire.

Smoke detectors are often battery powered, but may also be supplied from the wiring of a house. Where supplied from house wiring, a battery backup is still used to ensure proper operation of the smoke detector in the event a fire interrupts power to the smoke detector.

The term "smoke detector" may refer to any of a number of detector technologies that, in fact, may not be based upon the detection of smoke at all. For example, some detectors may detect the presence of carbon monoxide instead of smoke.

To enhance the effectiveness of smoke detection, smoke detectors are usually equipped with a relatively loud audible alarm. Further, since smoke may not penetrate all areas of a building, smoke detectors may need to be located in numerous locations for adequate protection of occupants.

To further enhance protection in large buildings, a separate alarm wire is often provided as an interconnection among smoke detectors. The interconnecting alarm wire is typically provided to trigger the alarms in all smoke detectors as part of an alarm system in the event that a fire is detected by any one smoke detector.

While the interconnection of prior art smoke detectors to form alarm systems works well, such systems are often expensive to install. Because of the importance of fire detection, a need exists for a better method of triggering alarms.

SUMMARY

A method and apparatus are provided for activating smoke detector alarms within a house. The method includes the steps of providing a plurality of smoke detectors dispersed among a plurality of locations within the house, detecting smoke within a first smoke detector of the plurality of smoke detectors, transmitting a radio frequency signal from the first smoke detector to a second smoke detector of the plurality of smoke detectors upon detection of smoke by the first smoke detector and activating an alarm within the second smoke detector upon detection of the radio frequency signal from the first smoke detector.

DETAILED DESCRIPTION OF AN ILLUSTRATED EMBODIMENT

Figure 1:
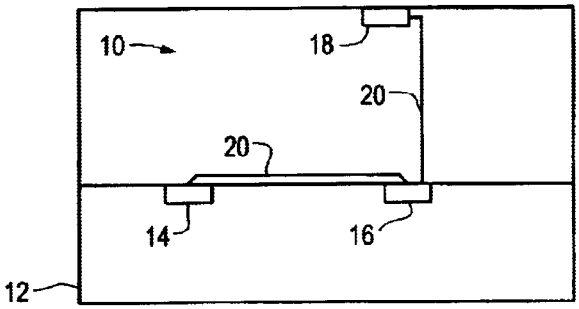
FIG. 1 is a block diagram of an alarm system in accordance with an illustrated embodiment of the invention.

FIG. 1 depicts a smoke detection system 10 shown generally in accordance with an illustrated embodiment of the invention. As shown, the smoke detection system 10 may include a number of smoke detectors 14, 16, 18 distributed throughout the living space of a house or apartment 12. The detectors 14, 16, 18 may receive power from house wiring 20.

Figure 2:
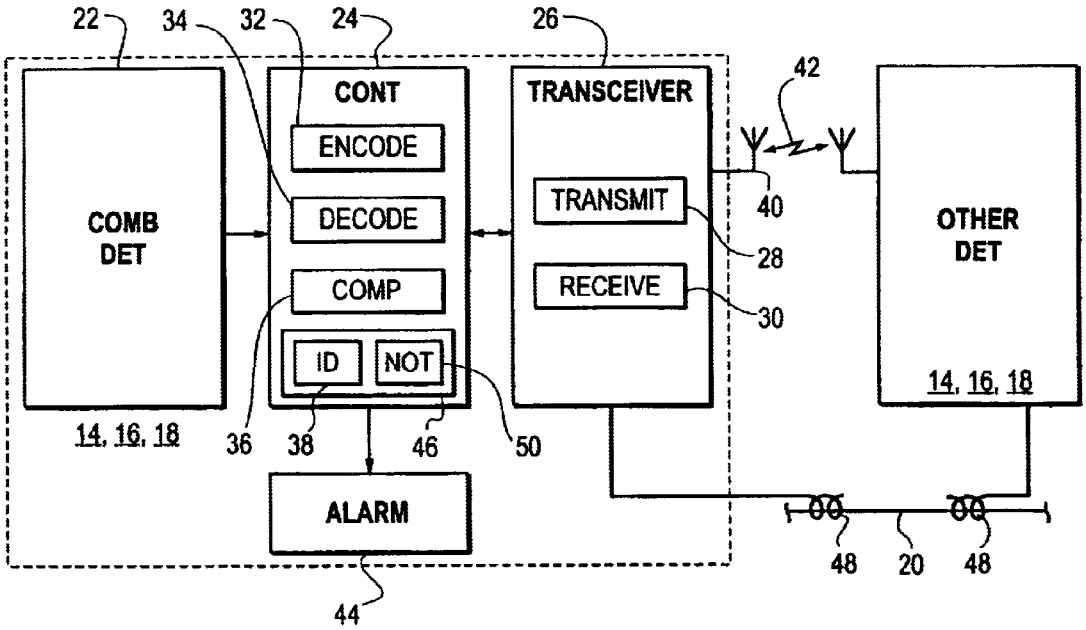
FIG. 2 is a block diagram of details of two smoke detectors of the system of FIG. 1.

FIG. 2 is a block diagram of two of the smoke detectors 14, 16, 18. Included within each smoke detector 14, 16, 18 may be the actual combustion detector 22, a controller (e.g., a central processing unit (CPU)) 24, an alarm module 44 and a transciever 26.

As used herein, the combustion detector 22 may be based upon any of a number of different technologies. For example, the detector 22 may be a conventional smoke detector (e.g., based upon absorption of an optical signal), gas products (e.g., carbon monoxide) or any other smoke detection technology.

Included within the transceiver 26 may be a radio frequency (rf) transmitter 28 and an rf receiver 30. The transmitter 28 may be of a relatively low power (e.g., less than 100 milliWatts) for transmission over a relatively short range (e.g., less than 1,000 feet).

Under the illustrated embodiment, the smoke detectors 14, 16, 18 may be interconnected through the power supply wiring 20 or through a wireless interface 42 for purposes of transferring an alarm among devices 14, 16, 18. Where interconnected through the power supply wiring, the rf signal may be transmitted among detectors 14, 16, 18 by direct coupling through a power supply neutral 20. The power supply neutral 20 in this case also being the neutral for the 120 volt alternating current supply that otherwise supplies power to the detectors 14, 16, 18.

Alternatively, the rf signal may be inductively coupled through either the hot or neutral conductors of the power supply wiring 20. An inductive coupler 48 may be used to inductively couple the radio frequency signal among detectors 14, 16, 18 through the wiring 20.

During normal operation, the controller 24 monitors the smoke detector 22 and the rf receiver 30. The rf transmitter 28 may remain deactivated under control of the controller 24. The combustion detector 22 may be monitored for a switch closure indicative of detection of a fire.

Upon detection of a fire (e.g., by a first detector 14), the combustion detector 22 may transfer notification to the controller 24. Upon receipt of the notification, the controller 24 may activate the audible alarm 44.

The controller 24 may also compose an alarm notification for transmission to a second and other detectors 16, 18. To compose an alarm, the controller 24 may retrieve a system identifier 38 of the system 10 from a memory 46 and transmit the system identifier along with an alarm code to the other detectors 16, 18.

To transmit the alarm, the controller 24 may transfer the alarm and system identifier 38 to an encoder 32. Within the encoder 32, the alarm and system identifier may be encoded under some known coding algorithm providing a predefined alarm sequence. The use of a predefined alarm sequence may be used to reduce, or eliminate, the possibility of false alarms due to interference.

Alternatively, the predefined sequence of the notification 46 may be have been previously encoded and stored as a file 50 within memory 46. In this case, the controller 24 may simply retrieve the coded notification 50, activate the transmitter 28 and transfer the notification to the transmitter 28.

The transmitter 28 may transmit the alarm notification through the antenna 40 through the wireless interface 42 to other detectors 16, 18. Alternatively, the transmitter 28 transmits the alarm notification to the other detectors 16, 18 through the power supply 20.

Other smoke detector 16, 18 may receive the alarm notification 46. As the alarm notification is received by the receiver 30, it may be transferred by the controller 24 to a decoder. Within the decoder, a system identifier may be decoded and transferred to a comparator 36. Within the comparator, a received system identifier is compared with a system identifier 38 stored in memory 46. If no match is found, the controller 24 discards the notification. If a match is found, the controller 24 of the detector 16, 18 may activate the alarm 44.

By transferring notification, detection of a fire by one smoke detector 14, 16, 18 may allow for activation of an audible alarm within all smoke detectors 14, 16, 18. The triggering of audible alarms from all detectors 14, 16, 18 without the necessity of dedicated alarm wiring considerably simplifies the installation of smoke detectors within houses and apartment buildings.

Specific embodiments of methods and apparatus for activating smoke alarms according to the present invention have been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention any and all modifications, variations, or equivalents that fall within the true spirit and scope of the basic underlying principles disclosed and claimed herein.

What is claimed is:

1. A method of activating smoke detector alarms within a house comprising:

providing a plurality of smoke detectors dispersed among a plurality of locations within the house;

connecting the plurality of smoke detectors to a set of 120 volt alternating current house wires to obtain power to operate the plurality of smoke detectors;

detecting smoke within a first smoke detector of the plurality of smoke detectors;

transmitting a radio frequency signal from the first smoke detector through a conductor of the house wires to a second smoke detector of the plurality of smoke detectors upon detection of smoke by the first smoke detector; and activating an alarm within the second smoke detector upon detection of the radio frequency signal from the first smoke detector.

2. The method of activating smoke detector alarms as in claim 1 further comprising routing the radio frequency signal through a neutral conductor of the house wires connected between the first and second smoke detectors.

3. The method of activating smoke detector alarms as in claim 1 further comprising routing the radio frequency signal through a hot conductor of the house wires connected between the first and second smoke detectors.

4. The method of activating smoke detector alarms as in claim 1 wherein the step of transmitting the radio frequency signal from the first smoke detector through the conductor of the house wires to a second smoke detector further comprises inductively coupling the radio frequency signal among the plurality of second smoke detectors through the conductor.

5. The method of activating smoke detector alarms as in claim 1 wherein the step of detecting smoke further comprises detecting carbon monoxide.

6. The method of activating smoke detector alarms as in claim 1 further comprising encoding the radio frequency signal with a system identifier of the smoke detection system.

7. The method of activating smoke detector alarms as in claim 1 wherein the step of encoding the radio frequency signal with a system identifier further comprises decoding radio frequency signals that do not contain the system identifier.

8. An apparatus for activating smoke detector alarms within a house comprising:

a plurality of smoke detectors dispersed among a plurality of locations within the house;

a plurality of house wires of the house connected among the plurality of smoke detectors to supply power the plurality of smoke detectors;

means for transmitting a radio frequency signal from a first smoke detector through a conductor of the plurality of house wires to a second smoke detector of the plurality of smoke detectors upon detection of smoke by the first smoke detector; and means for activating an alarm within the second smoke detector upon detection of the radio frequency signal from the first smoke detector.

9. The smoke detection system as in claim 8 further comprising means for routing the radio frequency signal through a neutral conductor of the house wires connected between the first and second smoke detectors.

10. The smoke detection system as in claim 8 further comprising means for routing the radio frequency signal through a hot conductor of the house wires connected between the first and second smoke detectors.

11. The smoke detection system as in claim 8 further comprising means for encoding the radio frequency signal with a system identifier of the smoke detection system.

12. The smoke detection system as in claim 8 wherein the means for encoding the radio frequency signal with a system identifier further comprises means for decoding radio frequency signals received by the smoke detectors and discarding radio frequency signals that do not contain the system identifier.

13. An apparatus for activating smoke detector alarms within a house comprising:

a plurality of smoke detectors dispersed among a plurality of locations within the house;

a plurality of house wires of the house connected among the plurality of smoke detectors to supply power to operate the smoke detectors;

a transceiver adapted to transmit a radio frequency signal from a first smoke detector through a conductor of the plurality of house wires to a second smoke detector of the plurality of smoke detectors upon detection of smoke by the first smoke detector; and a controller adapted to activate an alarm within the second smoke detector upon detection of the radio frequency signal from the first smoke detector.

14. The smoke detection system as in claim 13 wherein the conductor of the plurality of house wires further comprising a neutral conductor adapted to route the radio frequency signal from the first to the second smoke detector.

15. The smoke detection system as in claim 13 wherein the conductor of the plurality of house wires further comprising a hot conductor adapted to route the radio frequency signal from the first to the second smoke detector.

16. The smoke detection system as in claim 13 further comprising an encoder adapted to encode the radio frequency signal with a system identifier of the smoke detection system.

17. The smoke detection system as in claim 13 further comprising a decoder adapted to decode the radio frequency signal received by the second smoke detector and to discard radio frequency signals that do not contain the system identifier.

18. A smoke detection system for a house comprising:

a plurality of smoke detectors dispersed among a plurality of locations within the house;

a plurality of house wires connected to supply power to operate the plurality of smoke detectors;

an alarm operably coupled to each smoke detector of the plurality of smoke detectors and adapted to generate an audible alarm upon detection of smoke by the smoke detector; and a transceiver operably coupled to each smoke detector of the plurality of smoke detectors through a conductor of the plurality of house wires, said transceiver being adapted to activate the alarm within every other smoke detector through the conductor of the plurality of house wires upon detection of smoke by the smoke detector.

* * * * *